US007712455B2

(12) United States Patent
Szalai

(10) Patent No.: US 7,712,455 B2
(45) Date of Patent: May 11, 2010

(54) MAGNETIC DEVICE FOR TREATING LIQUIDS AND GASES

(76) Inventor: Tamás Szalai, Krúdy Gyula u. 21, Pécs H-7628 (HU)

( * ) Notice: Subject to any disclaimer, the term of this patent is extended or adjusted under 35 U.S.C. 154(b) by 0 days.

(21) Appl. No.: 11/718,515

(22) PCT Filed: Nov. 2, 2005

(86) PCT No.: PCT/HU2005/000119

§ 371 (c)(1),
(2), (4) Date: Mar. 17, 2008

(87) PCT Pub. No.: WO2006/048694

PCT Pub. Date: May 11, 2006

(65) Prior Publication Data

US 2009/0050115 A1 Feb. 26, 2009

(30) Foreign Application Priority Data

Nov. 3, 2004 (HU) ..... 0402221

(51) Int. Cl.
*F02M 27/04* (2006.01)

(52) U.S. Cl. ..... 123/538; 210/222

(58) Field of Classification Search ..... 123/536–539; 210/222, 695

See application file for complete search history.

(56) References Cited

U.S. PATENT DOCUMENTS 4,366,053 A * 12/1982 Lindler ..... 210/222
4,414,951 A * 11/1983 Saneto ..... 123/538
4,946,590 A * 8/1990 Hertzog ..... 210/222
5,271,369 A * 12/1993 Melendrez ..... 123/538
5,533,490 A * 7/1996 Pascall ..... 123/538
5,558,765 A * 9/1996 Twardzik ..... 210/222
5,589,065 A * 12/1996 Bogatin et al. ..... 210/222
5,664,546 A * 9/1997 De La Torre Barreiro ... 123/538
6,000,382 A 12/1999 Albisetti et al.
6,599,419 B2 * 7/2003 Hagans ..... 210/222
7,351,337 B1 * 4/2008 Milo et al. ..... 210/222
2003/0072696 A1 4/2003 Higa et al.

FOREIGN PATENT DOCUMENTS

| | | |
|---|---|---|
| DE | 10106532 | 8/2002 |
| EP | 0689869 | 1/1996 |
| JP | 1056956 | 3/1989 |
| JP | 1159518 | 6/1989 |
| JP | 1167513 | 7/1989 |

* cited by examiner

*Primary Examiner*—M. McMahon
(74) *Attorney, Agent, or Firm*—Birch, Stewart, Kolasch & Birch, LLP

(57) ABSTRACT

Magnetic device (1) for treating liquids and gaseous materials, comprising a housing (2) within which permanent magnets (6) are arranged defining a flow path (3). The housing (2) is made of magnetizable material, preferably soft iron, the flow path (3) consists of at least one magnetic pretreating unit (4) and at least one magnetic aftertreating unit (5) in which the permanent magnets (6) are arranged at the boundary of the flow path (3) in such a manner that the north (N) pole or the south (S) pole of the permanent magnets (6) faces the flow path (3). In the magnetic pretreating unit (4) the permanent magnets are arranged in a plane perpendicular to the flow direction (10) with alternating polarity, while the permanent magnets (6) are arranged with the same polarity in the magnetic aftertreating unit (5).

16 Claims, 5 Drawing Sheets

MAGNETIC DEVICE FOR TREATING LIQUIDS AND GASES

The invention relates to a magnetic device for treating liquids and gaseous materials, the magnetic treating device comprises a housing within which permanent magnets are arranged defining a flow path.

It has already been realized earlier that combustion efficiency can be enhanced if the material to be combusted is directed through a magnetic field in consequence of which dispersion of the particles of the material is improved and contamination is removed therefore the combustion process is more economical and more efficient.

Most fuel treating devices merely contain magnets arranged around the fuel pipe as it is described for example in patent application GB 2353563. It is known that the magnetic force away from the surface of the magnet decreases quadratically. For this reason only a portion of the original magnetic force has an effect on the fuel. In addition, fuel flows through the magnetic field so fast that the change caused by the magnetic field is only minimal. Fuel saving and decontaminating magnetic devices being in direct communication with the fuel do not have armatures. Hungarian utility model application (file-number 319) describes a device for spark ignition and/or compression ignition internal combustion engines. The aim of this solution is to reduce fuel consumption and emission of harmful, poisonous materials. The device is connected to the fuel-inlet pipe and contains magnets mounted in a plastic casing. The plastic casing is composed of two parts, one having a diameter larger than the other. In the part having the larger diameter three cuboid magnets of the same size are arranged forming the sides of an equilateral triangle. The south poles of the magnets face the interior of the triangle while the north poles are turned outward. The longitudinal axis defined by the magnets coincide with the longitudinal axis of the device. In the part having the smaller diameter six-twelve preferably ten zinc tablets or zinc alloy tablets are placed. Within the triangle a unipolar magnetic field is formed.

Hungarian patent application No. 177950 describes a magnetic fuel purifier having a rotating pre-purifier thereby the effectiveness of purification of liquid fuel is doubled. The fuel purifier has an inner pre-purifier rotating around a middle axis and an outer purifier surrounding the inner one. Fuel passes through a specially sintered granulated bronze filter. Onto the lower part of the middle axis a magnet is mounted fixedly surrounding the same to collect the magnetizable particles from the fuel. The casing of the fuel purifier is made of transparent, non-magnetic material, whose transparency is similar to that of glass. In this manner the operation of the fuel purifier can be inspected and when it is filled with contamination it can be emptied and cleaned.

None of the above solution uses armatures in order to enhance the magnetic effect, neither in case of the magnets positioned in the fuel path nor in case of the material chosen for the housing which could be formed from magnetizable material (for example soft iron) and used as armature.

Patent application EP 0791746 describes a fuel-saving apparatus in which armature and permanent magnets are used. According to this solution the fuel is directed into a unipolar cavity after a pre-magnetizing phase. However, the volume of the unipolar cavity is too small, fuel passes through it in a short time, in this way significant change in effectiveness is not experienced. Further, this document uses a non-magnetizable housing, only a magnetizable jacket of a small surface is applied around the permanent magnets. With this the magnetic lines of force can be concentrated to a lesser degree. In all systems known hitherto the magnetic force is far below 10000 Gauss.

Patent application U.S. Pat. No. 6,000,382 relates to a magnetic polarization device that can be used to improve the degree of atomization of a fuel that is to be injected and then combusted e.g. in internal-combustion engines with fuels of any type (gasoline, diesel fuel, alcohols), in burners and in heaters.

The efficiency of operation of the device disclosed in the above mentioned patent application can not be high enough since both ends of the system comprising three magnetic segments—assembled in the manner described—must have the same intensity. Flux can not be increased towards one of the pole ends in any manner, as it is stated incorrectly in this document. "Serial connection" of magnets of any intensity in this manner can not be solved on the basis of magnetic principles.

The related document does not use armature and shunt without which technical solution for creating a solely north pole-changing and solely south pole-changing labyrinth does not exist. Without this pole-changing labyrinth making the molecules of the material to be treated unstable is not ensured. The oriented unipolar magnetic field containing only south poles which ensures the same charge in order to prevent the atomized granules or particles from re-adhesion can not be created without armature and shunt.

Patent application US 2003/072696 A1 discloses an internal combustion engine in which one or more permanent magnets are arranged whose north pole or north poles face in a prescribed direction. All or any subset of the magnets are straddled in some fashion by at least two ceramic bodies formed by baking or firing of a substance wherein one or more items selected from among the group consisting of an effective microorganism colony and a derivative of an effective microorganism colony are arranged so as to permit contact with liquid fuel passing therethrough at an appropriate location in a fuel supply path.

Notwithstanding that FIG. 2 of the related document is slightly similar to the device of the present invention, still, from the explanation of the figure it is clear that the two devices are entirely different.

Effective operation of the device according to this solution is unlikely, since the flux lines of the north pole of the lower magnet connect to the south pole of the magnet being above it. The north pole of the latter closes on the south pole of the lower magnet. In this manner the fuel flowing through the holes passes through only a dispersed, minimal magnetic field which practically ineffective in terms of magnetic treatment.

In case of continuos use of devices which can be placed in the fuel tank, the required effect of treatment may be brought about only after a long time (more than ten hours). Upon refuelling they are unsuitable to treat a large quantity of fresh fuel, as coke is produced in the combustion chamber which is decomposed by the fuel treated according to the document. This is extremely harmful to the engine.

To sume it up, the latter two solutions have the following common shortcomings: no shunt and armature are used, the flow path can not be controlled or adjusted. A further disadvantage is that the material to be treated flows freely within the housing, i.e. its flow path is not controlled by deflectors, barriers and gaskets therefore the magnets do not have the required effect on the flowing material.

The object of the present invention is to provide a filtering, treating and transforming unit suitable for preparing fuels properly for use in internal combustion engine of any type, for improving efficiency of gas-powered and liquid fuel powered furnaces and for water treatment (water softening).

It is well known that the density of magnetic flux can be at least four-six times higher on the pole of the iron core opposite the magnet.

It has been realized that the steel tube housing can also be used as magnetic armature in addition to the armature of the inner magnets in order to guide the lines of force back without being dispersed. In this manner by means of sufficiently strong magnets systematically arranged in it, a value of 16,000 Gauss may be obtained at some places. In a properly designed magnetic circuit the lines of force—without being dispersed—can be guided back to places where the fuel flows. The fuel flowing through predefined gaps and directly communicating with the surface of the magnets may be treated more effectively. A better result may be obtained if the treatment performed in the bipolar magnetic field continues in a unipolar magnetic field whose efficiency further may be increased by means of an armature and a housing made of magnetizable material. In the concentrated magnetic field of the magnetic pretreating unit positioned in the centre part of the device according to the invention the treatment is performed by means of magnets arranged with alternating N-S poles, thereby the effectiveness of the unipolar magnetic field formed in the upper third part of the device is increased.

In one respect the present invention provides a device for treating liquids, the device comprises a housing within which permanent magnets are arranged defining a flow path. The housing is made of magnetizable material, preferably soft iron. The flow path consists of at least a magnetic pretreating unit and at least a magnetic aftertreating unit, in which the permanent magnets are arranged at the boundary of the flow path in such a manner that the north pole or the south pole of the magnets faces the flow path. In the magnetic pretreating unit the permanent magnets are arranged in a plane perpendicular to the direction of flow with alternating polarity, in the magnetic aftertreating unit the permanent magnets are arranged with the same polarity.

Preferably, a magnetic filter made of soft iron is placed in the flow path before the pretreating unit.

Advantageously, at least some of the permanent magnets are mounted onto an armature made of soft iron.

The liquid material is fuel used in internal combustion engines or water or liquid fuel for furnaces.

In another respect the present invention provides a device for treating gaseous materials, the magnetic treating device comprises a housing within which permanent magnets are arranged defining a flow path. The housing is made of magnetizable material, preferably soft iron. The flow path comprises at least a magnetic pretreating unit and at least a magnetic aftertreating unit, in which the permanent magnets are arranged at the boundary of the flow path in such a manner that the north pole or the south pole of the magnets faces the flow path. In the magnetic pretreating unit the permanent magnets are arranged in a plane perpendicular to the direction of flow with alternating polarity, in the magnetic aftertreating unit the permanent magnets are positioned with the same polarity.

Preferably, in the device for treating gaseous materials the permanent magnets are arranged on the inner wall of the housing and are embedded in synthetic resin, and the magnetic pretreating unit comprises four permanent magnets arranged in the cross-sectional plane of the flow path with alternating polarity, the permanent magnets are embedded equidistantly in the synthetic resin, and a plurality of magnetic units are positioned one after the other before the magnetic aftertreating unit in such a manner that with respect to their magnetic polarity the individual magnetic pretreating units relative to a preceding preatreating unit are rotated by 90° perpendicular to the flow direction, and the gaseous material is combustible gas.

Advantageously, the housing in both embodiments is a body of revolution, and the treating device is arranged vertically in the path of the liquid or gaseous material in such a manner that the liquid or the gaseous material is first directed through the magnetic pretreating unit then through the magnetic aftertreating unit.

A detailed description of the invention will now be disclosed with reference to the accompanying drawings in which.

In the following description housings 2 of the devices 1 according to the invention are bodies of revolution and are shown vertically in the figures. Vertical arrangement is practical, because on the one hand the flow path 3 can be utilized in the best manner, on the other hand it is instrumental in deaeration in certain applications. In each figure notation 'S' represents the south pole and 'N' represents the north pole. The terms 'lower' and 'upper' are to be understood as depicted in the figures and the terms 'before' and 'after' are used with reference to the flow direction 10.

Figure 1:
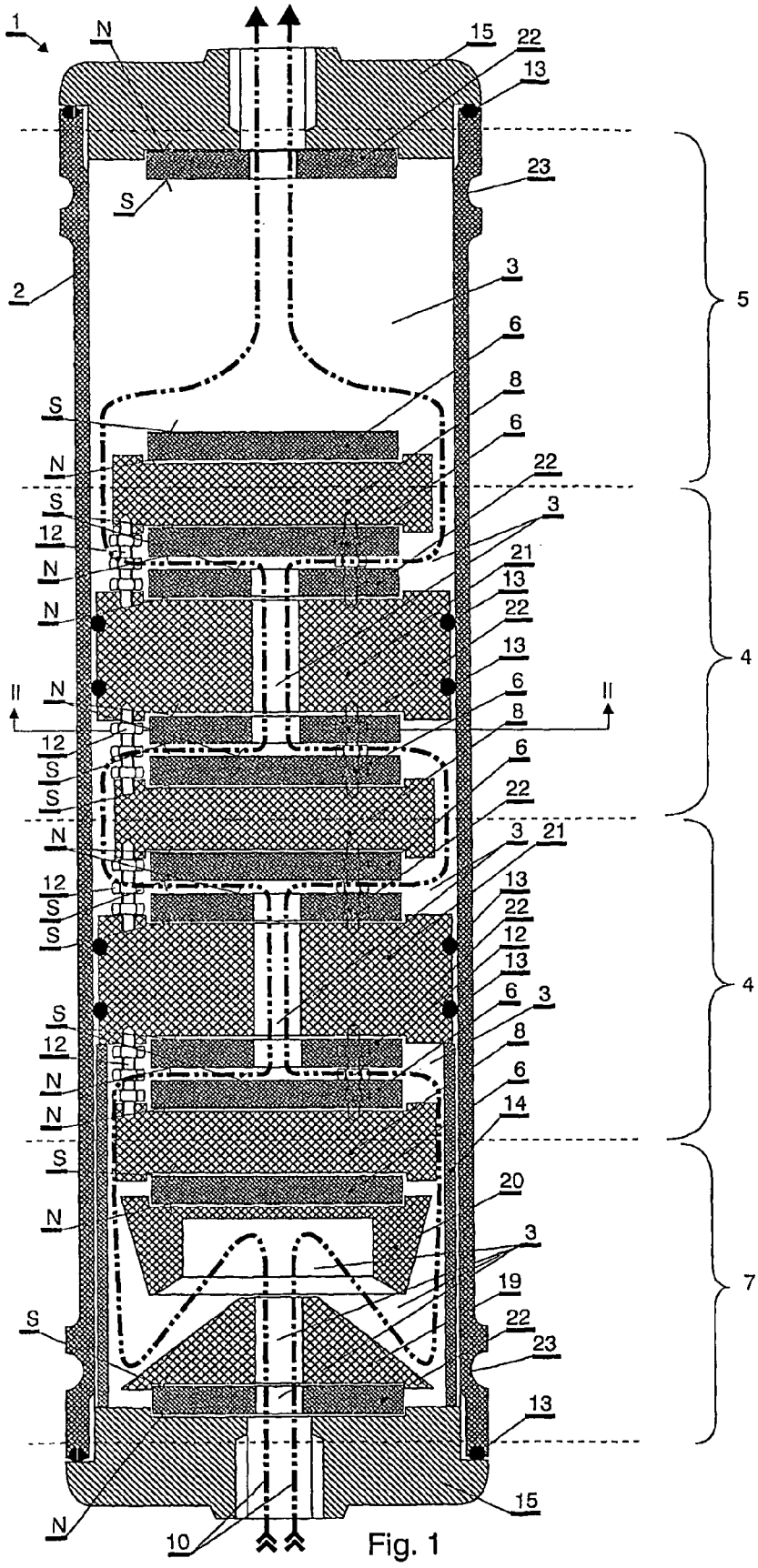
FIG. 1 shows the cross-section of an exemplary embodiment of the device for treating fuels used in internal combustion engines as viewed from the side.
Figure 2:
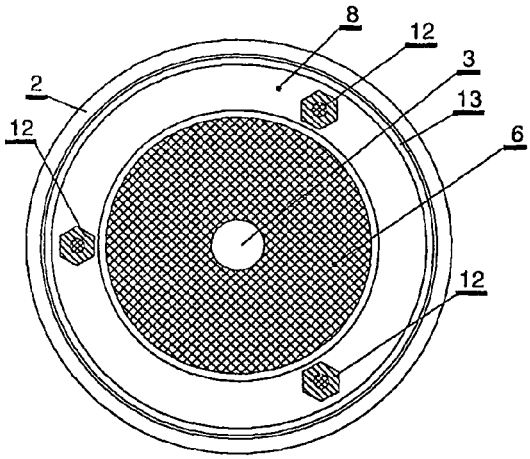
FIG. 2 shows the cross-section of the device of FIG. 1 taken along line II-II as viewed from the bottom.
Figure 5:
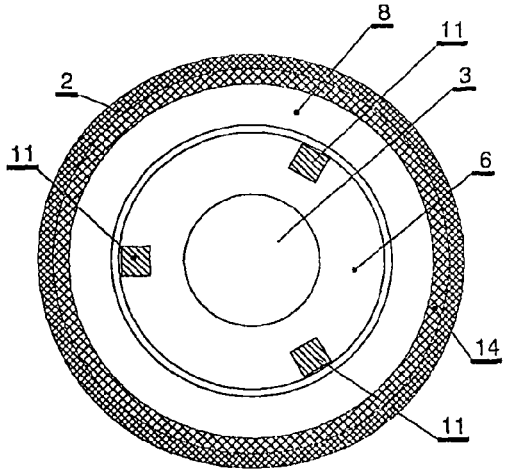
FIG. 5 shows the cross-section of the water treating device of FIG. 4 taken along line V-V as viewed from the bottom.
Figure 3:
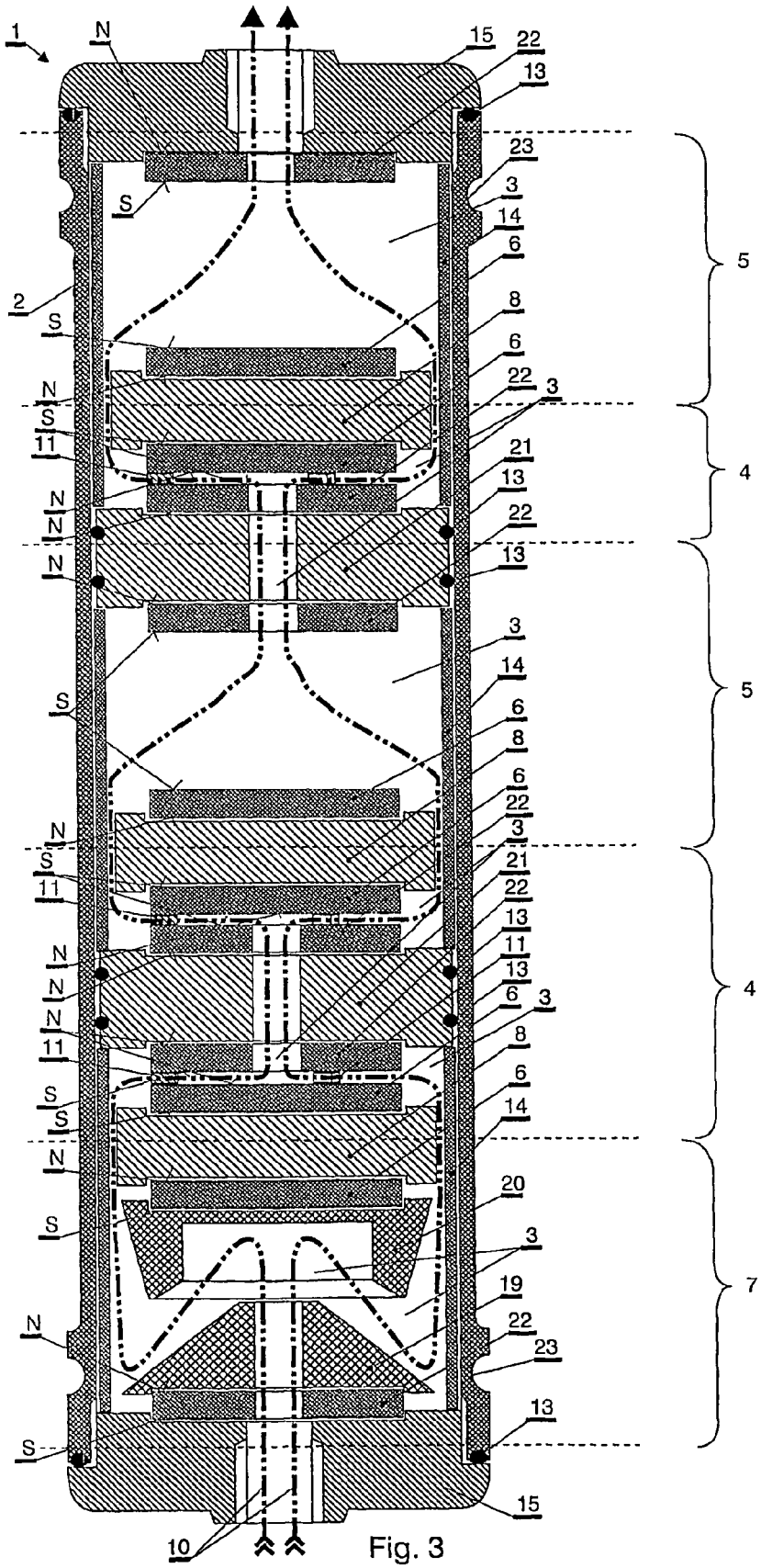
FIG. 3 shows the cross-section of another exemplary embodiment of the device for treating fuels used in internal combustion engines as viewed from the side.

In FIG. 1 the housing 2 of the fuel treating device 1 is closed by covers 15 sealed with an O-ring respectively. In the middle of the lower cover 15 a fuel inlet provided with internal threads is formed in a known manner for connection with the incoming fuel pipe. In the middle of the upper cover 15 a fuel outlet provided with internal threads is formed in a known manner for connection with the outgoing fuel pipe. The dotted/broken lines show the flow direction 10 of the fuel through flow path 3. In the superficies of housing 2 two curved grooves 23 are formed suitable for receiving a clamp. At first, fuel flows through magnetic filter 7, then through magnetic pretreating unit 4, finally, prior to leaving the fuel treating device 1 it flows through the magnetic aftertreating unit 5. The magnetic filter 7 consists of a bored magnet 22 (it is only different from permanent magnet 6 in that it has a bore-hole in its middle) positioned onto cover 15; a first armature 19 positioned onto bored magnet 22; a second armature 20 placed opposite the first armature; a permanent magnet 6 positioned onto the second armature 20, and an armature 8. A brass spacer sleeve 14 guarantees that the second armature 20 and the first armature 19 are properly spaced in housing 2. Each of these are bodies of revolution. The diameter of armature 8 is determined so that a gap sufficient for the through-flowing medium is left between the superficies of the armature 8 and the spacer sleeve 14. The magnetic pretreating unit 4 consists of an armature 8 common with magnetic filter 7; a permanent magnet 6 positioned onto armature 8; a bored magnet 22 placed opposite the permanent magnet 6; a bored armature 21 positioned onto bored magnet 22; a further bored magnet 22 positioned onto bored armature 21; a permanent magnet 6 placed opposite the bored magnet 22; and an armature 8 positioned onto permanent magnet 6. Armature 8 is a lead-through armature in respect of the lines of force. Bored armature 21 is a lead-back armature in respect of the lines of force, because the permanent magnets 6 positioned on its lower and upper surface have the same polarity, in this way it directs the lines of force onto housing 2 through its superficies. The directions of lines of force are not shown in the figures since it should be clear for those skilled in the art. The distance between armatures 8 and bored armatures 21 as well as the extent of the flow path 3 are determined by threaded spacers 12 arranged in a way shown in FIG. 2. A portion of the axes of threaded spacers 12 is suitable for being grasped by means of a suitable tool. Further, in the vicinity of the ends of the axes fixing nuts are arranged. The ends of the axes fit into a blind hole and the distance between the magnets can be regulated by means of them. Between a pair of magnets three threaded spacers 12 are arranged at a distance of 120° from each other. Further, the diameter of armature 8 is determined so that a gap sufficient for the through-flowing medium is left between the superficies of the armature 8 and the housing 2. In the embodiment shown in FIG. 1 two magnetic pretreating units 4 are placed one after the other having the same structure, but the sequence of polarity is reversed. This solution demonstrates that the initial polarity is indifferent (in case of the filter, too), however, it is advantageous to have the south pole S as final polarity before magnetic aftertreating unit 5. Spacer sleeve 14 determines the position of the first magnetic pretreating unit 4 within housing 2 and magnetic pretreating unit 4 determines the position of magnetic filter 7. Positions of the elements of magnetic filter 7 are further guaranteed by the magnetic pull of the elements. Magnetic aftertreating unit 5 consists of the upper part of the armature 8 of magnetic pretreating unit 4; a permanent magnet 6 positioned on the same; and bored magnet 22 positioned oppositely. Permanent magnet 6 and bored magnet 22 are positioned so that their faces having the same polarity (either S or N) are turned against each other. A better result can be obtained when S pole is opposed to S pole. This solution is shown in the Figure. Therefore it is more advantageous to have the south pole S as the final polarity of the magnetic pretreating unit 4 before magnetic aftertreating unit 5. The embodiment shown in FIG. 3 is different from the embodiment of FIG. 1 in that after magnetic filter 7 one magnetic pretreating unit 4 is positioned followed by one magnetic aftertreating unit 5. It is followed by a half magnetic pretreating unit 4 which is followed by a further magnetic aftertreating unit 5 in the treating device 1. Further, instead of threaded spacers 12 spacing blocks 11 are used for determination of the cross-section of flow path 3. The arrangement of spacing blocks 11 is shown in FIG. 5. Although FIG. 5 is not a section of FIG. 2, the structure is very similar (only the diameter of the middle bore is different), therefore it is not shown in a separate figure. The positions of the individual units (magnetic filter 7, magnetic pretreating unit 4 and magnetic aftertreating unit 5) are determined by means of three brass spacer sleeves 14. Assembly is easier in case of this embodiment. When assembling treating device 1 according to the invention the individual elements may be arranged in housing 2 in the same order as described in relation to FIG. 1.

Treating device according to FIGS. 1 and 3 is applicable for filtering, treating and polarizing/pretreating fuels used in internal combustion engines and liquid fuel used for furnaces (e.g.: oil-burning furnace) and operates as follows:

Fuel entering the flow path 3 through fuel inlet of the lower cover 15 passes through the first armature 19 of magnetic filter 7, turns back at the second armature 20 and leaves the major part of contamination behind in the extremely strong magnetic field being present there. Thereafter the fuel flows through the gap between the superficies of armature 8 and brass spacer sleeve 14 into magnetic pretreating unit 4, between permanent magnet 6 and bored magnet 22. Then it flows through flow path 3 provided in the bore-hole of bored armature 21, and after flowing through a further bored magnet 22 the flow direction of the fuel is changed in the gap between bored magnet 22 and permanent magnet 6 and it flows along the superficies of armature 8 and leaves the first magnetic pretreating unit 4. That is, it follows flow direction 10 along flow path 3. The dotted/broken lines in the figure show the flow direction 10 of the fuel in flow path 3. In the embodiment according to FIG. 1 two magnetic pretreating units 4 are positioned one after the other. From the second magnetic pretreating unit 4 the fuel flows through the gap between the superficies of armature 8 and housing 2 into unipolar magnetic aftertreating unit 5 where the fuel is polarized. Advantageously the polarity of the unipolar magnetic field in magnetic aftertreating unit 5 is S. It has been experienced that a higher efficiency can be obtained when the polarity of the unipolar magnetic field is S than in case of N polarity. The polarized fuel leaves magnetic aftertreating unit 5 through fuel outlet formed in the middle of the upper cover 15 and enters e.g. the proportioner of the internal combustion engine. Spacer sleeve 14 (FIG. 1) as well as the lower spacer sleeve 14 (FIG. 3) are used as means for adjusting the distance between the first armature 19 and the second armature 20 of magnetic filter 7. The embodiment shown in FIG. 3 is different from the embodiment of FIG. 1 in that the fuel flows through two unipolar magnetic aftertreating units 5, and only a half magnetic pretreating unit is positioned in between the two magnetic aftertreating units 5.

By the help of threaded spacers 12 shown in FIG. 1 the correct cross-section necessary for the required fuel quantity can be set. The required fuel quantity depends on the type, the size of the internal combustion engine, that is it depends on the fuel consumption of the engine. It can be determined by calculation of cross-section or experientially. This solution is obvious for those skilled in the art. In FIG. 3 instead of threaded spacers 12 spacing blocks 11 are used for setting the cross-section of the flow path, and a plurality of superimposed spacer sleeves 14 are used for setting bored armatures 21 in position. This makes the process of assembling/setting easier, however, in different applications differently sized spacing blocks 11 and spacer sleeves 14 may be needed. O-ring 13 positioned within housing 2 is provided for sealing the gap between bored armature 21 and housing 2 in order to guarantee the required flow direction 10 of the fuel. In case of the embodiment shown in FIG. 3 the block consisting of the half magnetic pretreating unit 4 and the succeeding second magnetic aftertreating unit 5 may be repeated optionally, depending on the required output of treating device 1. Then the N pole of the magnetic pretreating unit 4 treats the fuel in the gap adjusted by means of the spacing block, and the inside measurement of the following unipolar (S polarity) magnetic aftertreating unit 5 is adjusted by means of spacer sleeve 14. The brass spacer sleeves 14 block the lines of force of the N pole coming from the housing 2 so they have no effect on the medium to be treated, in this manner the effectiveness of the unipolar magnetic aftertreating unit 5 is enhanced. The vertically oriented housing 2 guarantees automatic de-aeration of the fuel entering at the bottom and flowing upwards. Advantageously, treating device 1 is positioned in the fuel system after the fine filter, before the proportioner, or before the AC-pump (fuel-feed pump) and the carburettor or between the AC-pump and the carburettor.

Figure 4:
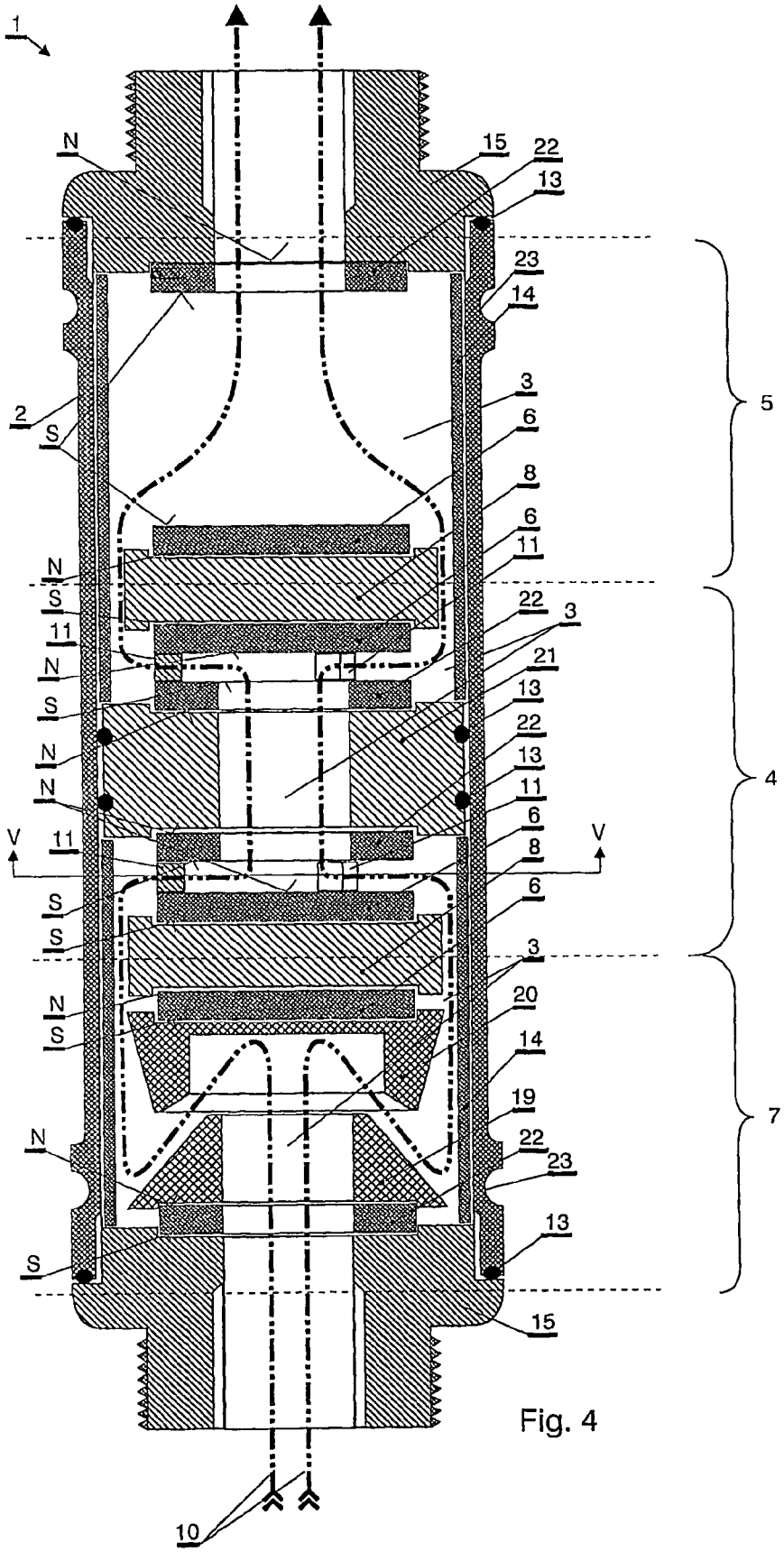
FIG. 4 shows the cross section of an exemplary embodiment of the water treating device as viewed from the side.

Treating unit 1 according to FIG. 4 is applicable for water softening. In FIG. 1 the housing 2 of the treating device 1 is closed by covers 15 sealed with an O-ring respectively. In the middle of the lower cover 15 a water inlet provided with internal threads is formed in a known manner for connection with the incoming water pipe. The outside surface of the connecting sleeve of cover 15 is corrugated for gripping. In the middle of the upper cover 15 a water outlet provided with internal threads is formed in a known manner for connection with the outgoing water pipe. The dotted/broken lines show the flow direction 10 of the water in flow path 3. In the superficies of housing 2 two curved grooves 23 are formed suitable for receiving a clamp. At first, water flows through magnetic filter 7, then through magnetic pretreating unit 4, finally, prior to leaving the treating device 1 it flows through the magnetic aftertreating unit 5. The magnetic filter 7 consists of a bored magnet 22 (it is only different from permanent magnet 6 in that it has a bore-hole in its middle) positioned onto cover 15; a first armature 19 positioned onto bored magnet 22; a second armature 20 placed opposite the first armature; a permanent magnet 6 positioned onto the second armature 20, and an armature 8. A brass spacer sleeve 14 guarantees that the second armature 20 and the first armature 19 are properly spaced in housing 2. Each of these are bodies of revolution. The diameter of armature 8 is determined so that a gap sufficient for the through-flowing medium is left between the superficies of the armature 8 and the spacer sleeve 14. The magnetic pretreating unit 4 consists of an armature 8 common with magnetic filter 7; a permanent magnet 6 positioned onto armature 8; a bored magnet 22 placed opposite the permanent magnet 6; a bored armature 21 positioned onto bored magnet 22; a further bored magnet 22 positioned onto bored armature 21; a permanent magnet 6 placed opposite the bored magnet 22; and an armature 8 positioned onto permanent magnet 6. The distance between armatures 8 and bored armatures 21 thereby the size of the flow path 3 are determined by spacing blocks 11 arranged in a way shown in FIG. 5. Between a pair of magnets three spacing blocks 11 are arranged at a distance of 120° from each other. Further, the diameter of armature 8 is determined so that a gap sufficient for the through-flowing medium is left between the superficies of the armature 8 and the spacer sleeve 14. Magnetic aftertreating unit 5 consists of the upper part of the armature 8 of magnetic pretreating unit 4; a permanent magnet 6 positioned on the same; and bored magnet 22 positioned oppositely. Permanent magnet 6 and bored magnet 22 are positioned so that their faces having the same polarity (either S or N) are turned against each other. A better result can be obtained when S pole is opposed to S pole. This solution is shown in the Figure.

Treating device according to FIG. 4 operates as follows:

Water entering the flow path 3 through water inlet of the lower cover 15 passes through the first armature 19 of magnetic filter 7, turns back at the second armature 20 and leaves the major part of contamination behind in the extremely strong magnetic field being present there. Thereafter the water flows through the gap between the superficies of armature 8 and brass spacer sleeve 14 into magnetic pretreating unit 4, between permanent magnet 6 and bored magnet 22. Then it flows through flow path 3 provided in the bore-hole of bored armature 21, and after flowing through a further bored magnet 22 the flow direction of the water is changed in the gap between bored magnet 22 and permanent magnet 6 and it flows along the superficies of armature 8 and leaves the first magnetic pretreating unit 4. That is, it follows flow direction 10 along flow path 3. The dotted/broken lines in the figure represent the flow direction 10 of the water in flow path 3. From the magnetic pretreating unit 4 the water flows through the gap between the superficies of armature 8 and housing 2 into unipolar magnetic aftertreating unit 5. Advantageously the polarity of the unipolar magnetic field in magnetic aftertreating unit 5 is S. It has been experienced that a higher efficiency can be obtained when the polarity of the unipolar magnetic field is S than in case of N polarity. The water leaves magnetic aftertreating unit 5 through water outlet formed in the middle of the upper cover 15 and flows into the pipe system. Crystalline grains of salt (mostly Ca) become much finer due to the unipolar magnetic field being present in the magnetic aftertreating unit 5. Evaporating water leaves a sand-like, white, dusty material of loose structure behind instead of a solid, hard scale-coating.

The size of spacing block 11 (determining the distance between permanent magnet 6 and bored magnet 22) and the diameter of armature 8 as well as the diameters of the bore-holes of bored armature 21 and bored magnet 22 are determined so that a cross-section suitable to the cross-section of the water inlet/outlet pipes is guaranteed. The spacing blocks 11 are made of brass. O-ring 13 positioned within housing 2 is provided for sealing the gap between bored armature 21 and housing 2 in order to guarantee the required flow direction 10 of the water.

The vertically oriented housing 2 makes possible for the water entering at the bottom and flowing upwards to de-aerate housing 2. It has double function: on the one hand it guarantees that the entire surface of the magnets are used for treatment, on the other hand oxidation of metals within housing 2 is prevented.

In another embodiment water is led from sidewards into housing 2 at the bottom part of the treating device 1 according to the invention, and instead of the lower cover 15 (FIG. 4) a bag filter is used which may be screwed off manually for cleaning purposes. After cleaning (removing the contamination filtered out) it may be replaced. Advantageously, the water treating device according to the invention is placed in the water system after the water-meter, before the branching points.

Figure 7:
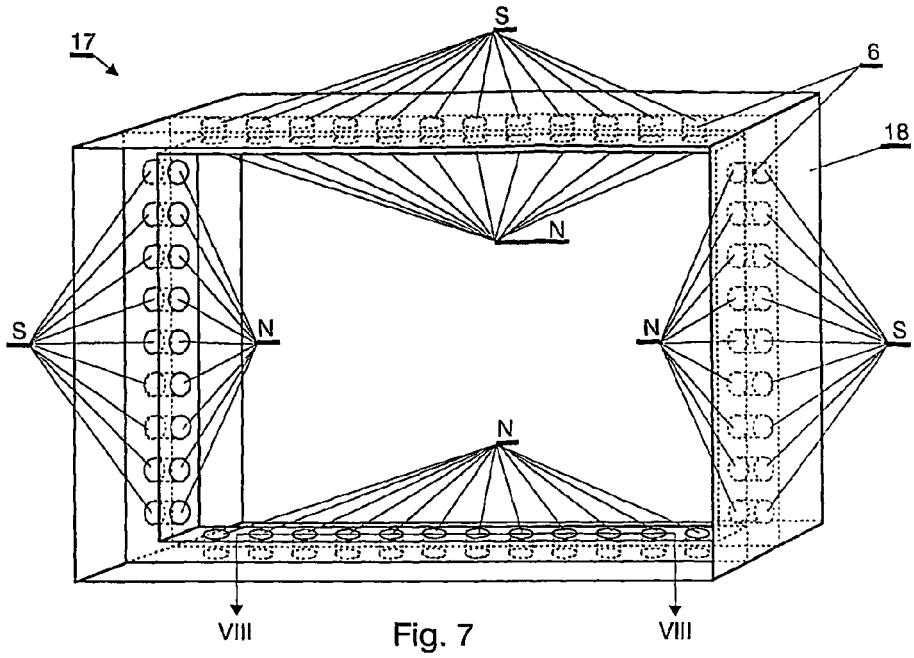
FIG. 7 is a perspective view of the combustion promoting suction orifice provided for air supply.
Figure 8:
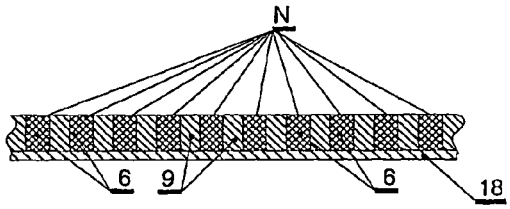
FIG. 8 is a cross-section of the suction orifice of FIG. 7 taken along line VIII-VIII as viewed from the side.
Figure 6:
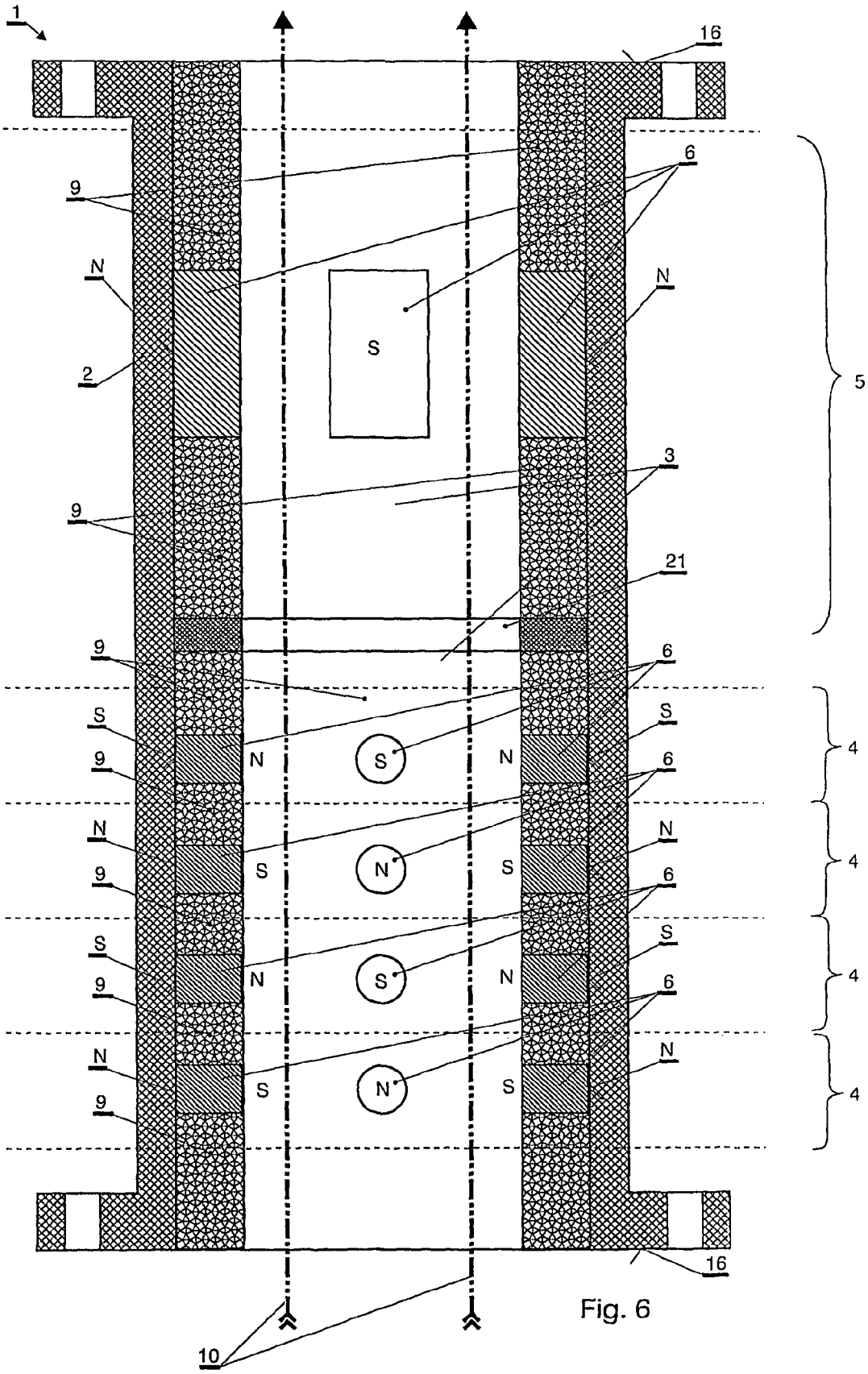
FIG. 6 shows the cross-section of an exemplary embodiment of the gas treating device as viewed from the side.

The treating device 1 shown in FIG. 6 is applicable for treating gases and can be installed for example in gas inlets of furnaces powered by natural gas or PB-gas. In order to enhance efficiency of combustion a suction orifice 17 shown in FIG. 7 is provided for treating the inlet air as well. In FIG. 8 a section of a portion of the suction orifice 17 containing permanent magnets 6 can be seen. High flow velocity of the gas and the material (generally iron pipe) used for gas fittings do not make possible for the gas flowing in the gas-pipe to be affected noticeably by the magnets placed externally. The treating device 1 according to the invention is applicable for this purpose, however, considering that the flow velocity of the gas in large-diameter pipes is very high, embodiments of the device as described in case of fuels and water would cause loss of flow velocity and pressure. In order to avoid this, a tube made of synthetic resin 9 in which permanent magnets 6 are positioned is placed within housing 2 in such a manner that installation of treating device 1 into the gas-pipe does not cause reduction in diameter and in cross-section for the flowing gas, and gas is not forced to change flow direction. Therefore the inner diameter of the tube made of synthetic resin 9 corresponds to the inner diameter of the gas-pipe in which treating device 1 is installed. Consequently, in this embodiment the flow direction 10 is an unbroken straight line. Also, the flow path 3 forms an unbroken straight line. In case of this embodiment, in like manner as in case of the previously described embodiments, magnetic pretreating unit 4 produces a magnetic field of alternating polarity and magnetic aftertreating unit 5 produces a unipolar magnetic field. In the cross-sectional area of the magnetic pretreating unit 4 perpendicular to the flow direction 10 four permanent magnets 6 are positioned in housing 2 arranged at a distance of 90° from each other in such a manner that their S poles or N poles face alternately the flow path 3. The other poles of the permanent magnets 6 face the inner surface of housing 2. Magnetic pretreating unit 4 having permanent magnets 6 arranged as previously described may be repeated optionally. The embodiment shown in FIG. 6 contains four magnetic pretreating units. With respect to the polarity of the permanent magnets 6 the individual magnetic pretreating units 4 are rotated by 90° relative to the preceding preatreating unit 4. In the cross-sectional area of magnetic aftertreating unit 5 four permanent magnets 6 are positioned in housing 2 arranged at a distance of 90° from each other in such a manner that their S poles face the flow path 3. The other poles of the permanent magnets 6 face the inner surface of housing 2. Magnetic pretreating unit 4 and magnetic aftertreating unit 5 are separated by bored armature 21. The diameter of the bore-hole of bored armature 21 corresponds to the inner diameter of the treating device formed in housing 2. Naturally, a bored armature 21 may be positioned after each magnetic pretreating unit 4. The permanent magnets 6 in magnetic pretreating unit 4 are cylindriform. The permanent magnets 6 in magnetic aftertreating unit 5 are cuboid. Permanent magnets 6 having such shapes guarantee effective pattern of magnetic lines of force. Naturally, permanent magnets 6 of other shapes may also be used. The gas treating device 1 according to the invention can be installed in the gas-pipe by means of flange 16 in a known manner using suitable gaskets. Preferably, the treating device 1 is arranged vertically. Obviously, the connecting end of the gas-pipe is provided with a flange corresponding to the size of flange 16 of treating device 1.

As it was mentioned previously, the inlet air is also treated in order to enhance efficiency of combustion by means of a suction orifice 17 shown in FIG. 7. Suction orifice 17 is placed in the combustion air inlet. Suction orifice 17 consists of a frame 18 made of soft iron. The inner surface of frame 18 is coated with synthetic resin 9 containing disc-shaped permanent magnets 6. N poles of permanent magnets 6 face the inside of frame 18 while their S poles face the frame. Permanent magnets 6 are completely embedded in synthetic resin 9 in the same manner as in case of gas treating device 1. The entering air is affected only by the N pole.

The gas treating device 1 according to the invention operates as follows: all permanent magnets 6 assist the process of treating, i.e. filtering, purifying and polarizing. Cylindriform permanent magnets 6 in magnetic pretreating unit 4 are positioned with alternating polarity. (When spreaded out the arrangement would present a chessboard pattern.) In magnetic pretreating unit 4 as well as in magnetic aftertreating unit 5 the number and the size of the permanent magnets 6 should be determined as a function of the diameter of the pipe or the volume of gas flowing in the pipe. In the magnetic pretreating unit 4 the lines of force from the N poles of the cylindriform permanent magnets 6 proceed towards the centre of flow path 3 onto the S pole of another permanent magnet 6. Without being dispersed, the lines of force of the N pole of this latter permanent magnet 6 arrive back onto the S pole of the preceding permanent magnet 6 through housing 2 (like through an armature). Lines of forces starting from the N poles of those permanent magnets being in the lowest or uppermost magnetic pretreating unit 4 proceed towards the centre of flow path 3, then without being dispersed they arrive onto the S pole of the same permanent magnet 6 through flange 16 or bored armature 21. Therefore, in the magnetic pretreating units 4 arranged one after the other the originating and ending lines of force of N poles and S poles follow each other by turns. It causes the gas to move forward helically in magnetic treating device 1. Due to the pretreatment applied on the hydrocarbon chain of the gas in pretreating unit 4 of the treating device 1 the effectiveness of the unipolar magnetic field formed in magnetic aftertreating unit 5 is enhanced significantly. The lines of force from the N poles of permanent magnets 6 being in the unipolar aftertreating unit 5 proceed towards the centre of flow path 3 and arrive onto the S poles of permanent magnets 6 through housing 2 which serves as an armature.

As it was mentioned, permanent magnets 6 and bored armature 21 are positioned in a tube made of synthetic resin 9 the cross-section of which corresponds to the original cross-section of the gas-pipe in order to guarantee unhampered flow of the gas. To solve this, the permanent magnets 6 of magnetic pretreating unit 4 and magnetic aftertreating unit 5 are fixed onto the inner wall of housing 2 in determined position for example by means of an adhesive. Then a piece of tubing correspondent to the required inner diameter is placed into housing 2. The exterior surface of the piece of tubing is coated with mould-release agent, and the gap between the housing 2 and the piece of tubing is filled in with synthetic resin 9. After hardening of the synthetic resin 9 the piece of tubing can be removed. Synthetic resin 9 does not interfere with the lines of force. In this embodiment gas is affected by the S poles of the permanent magnets 6 being in magnetic aftertreating unit 5, the N poles have no effect on it. In this way uniformly D polarized gas can be delivered to the point of consumption. After dismounting housing 2 the treating device 1 can be cleaned.

Magnetization of the combustion air is very simple. Combustion air is directed through suction orifice 17 between the inwardly facing N poles of permanent magnets 6 positioned in frame 18, as a result of which the polarization of the combustion air will be N. The N polarized particles of the combustion air combine with the D polarized particles of the gas aggressively, quickly, thereby mixing of the two gaseous material is enhanced and the process of combustion becomes more intensive. If gas treating and combustion air treating devices are not used, a portion of the gas particles would leave the flame without finding their oxygen pairs. This problem is eliminated and the combustion efficiency is enhanced when the device according to the present invention is used. Advantageously, the treating device 1 according to the invention is placed after the fine filter, before the burner nozzle in case of oil-burning furnaces, and it is placed after the gas-meter, before the gas appliance in case of gas systems.

The advantage of the present invention is that treatment of materials in the concentrated magnetic field of the preatreating unit takes place in a controlled manner by alternating the N-S poles, thereby efficiency of the unipolar field of the magnetic aftertreating unit is significantly enhanced. The use of armature (i.e. controlled lead-back of lines of forces, concentration) makes it possible to create an intensive magnetic field as a result of which the magnetic 'filter-trap' in the device is able to collect contaminants smaller than two microns and polarize the medium to be treated. The structure of the treating device according to the invention as well as the control factors have been determined on the basis of several years' results of experiments, practical experiences. The effect of the intensity of the magnetic fields and also setting the distance between them as well as the armature of the magnets and orientation thereof (magnetic circuits) have been tested instrumentally and have been analyzed. The treating device according to the invention has been tested in cars, engines, camions, furnaces, water and gas systems of various types. The brake-horsepower efficiency in case of internal combustion engines provided with the treating device according to the invention has been proved. The magnetic trap formed by annular concentration of the magnetic force of the superstrong magnets is very important. This makes collection of tiny magnetizable metallic contamination particles from the flowing material possible. These particles would pass trough even a fine filter. Without the treating device according to the invention contamination being present in the fuel system may damage the proportioner and the carburettor nozzles. Magnetic pretreating unit has not been used in the prior art. An essential portion of it is the tubiform steel housing for guiding the magnetic lines of force to the disc-shaped armature, by means of which the lines of force are guided back—without any loss—to portions of the magnetic pretreating unit having the smallest cross-section. The fuel treating device according to the invention guarantees that the required amount of fuel necessary for operation of the given appliance is provided at places having the smallest cross-section even at a temperature of −30° C. in case of low efficiency engines, too. The intensity of the unipolar magnetic field in the magnetic aftertreating unit is at least four times higher than in any known solutions. This effect is due to the controlled lead-back of the lines of force through the armatures. Without the alternately arranged N-S poles in the magnetic pretreating unit the device would not operate effectively even if an extremely intensive unipolar magnetic field is provided in the magnetic aftertreating unit. In addition to a fuel saving rate of 10%, a 30% decrease in smoke emission and a less gas-development in the crankcase that customarily can be obtained in case of known treating devices, the noise level and the vibration of the engine is decreased, less damage of environment is caused when the treating device according to the invention is used. Further, the temperature of the exhaust gas during operation is decreased by 30%, also, the oil consumption of the engine is decreased, and the lifetime of the engine is increased. At the time of the oil change the dead oil is brown not black, its viscosity is high (it is lubricous, sticky), and there is no oil sludge and coke breeze in the oil filter. Due to the fuel filtered by means of the device according to the invention endurance of the proportioner and the carburettor nozzles is increased. The combustion chamber of the engine will be free from coke. Experiments proved that the combustion chamber of the engine remains free from coke after 6 years in use when the device according to the invention is installed in new or renewed engines. The lifetime of the electric appliances is increased, failure of the appliances is less possible due to the easier cold-start. The torque of the engine is increased the engine becomes more dynamic.

The water treating device according to the invention has several advantages. Water will contain less pollution thereby it is healthier. There is less likelihood of lithiasis (bilestone, kidney stone) even in case of people being susceptible to it. It is good for allergic diseases, dermatosis (pruritus, desquamation, ichthyosis). Animals drinking the water treated by means of the device according to the invention are healthier, vaccination for diarrhoeal diseases may be omitted. When treated water is used for watering plants their growth is more intensive, their fruit tastes better, preserves its quality for a longer time, etc. because the fine crystals can pass through the cell membrane easily while the untreated rough granules can not. Due to the softer water housework in which water is used (e.g.: washing) can be done more economically, less detergent is needed. Boilers, pipe systems, taps, washing machines are prevented from getting scaly, and the outlet water contains less chemical substance.

The advantage of the gas treating device according to the invention is that less gas is used for heating up the system, so operation is more economical. It is environmentally sound, less non-burnt gas is discharged, the specific use of gas is decreased. Also, the maintenance costs are decreased.

The invention claimed is:

1. A magnetic device for treating liquids, comprising:

a housing made of magnetizable material;

permanent magnets having a north pole and a south pole arranged within the housing and defining a flow path, the permanent magnets arranged at the boundary of the flow path so that the north (N) pole or south (S) pole faces the flow path, wherein said flow path comprises:

at least one magnetic pretreating unit, in which, said permanent magnets are arranged in a plane perpendicular to the flow direction, and a pair of permanent magnets having faces of opposite polarity facing one another; and at least one magnetic aftertreating unit, in which said permanent magnets are arranged with faces of the same polarity facing one another.

2. The magnetic device according to claim 1, wherein a magnetic filter made of soft iron is placed in said flow path before said pretreating unit.

3. The magnetic device according to claim 1, wherein at least some of the permanent magnets are mounted onto an armature or bored armature made of soft iron.

4. The magnetic device according to claim 1, wherein said liquid is fuel used in internal combustion engines or water or liquid fuel for furnaces.

5. The magnetic device according to claim 1, wherein said housing is a body of revolution.

6. The magnetic device according to claim 1, wherein said device is arranged vertically in the path of the liquid in such a manner that the liquid is first directed through said magnetic pretreating unit, then through said magnetic aftertreating unit.

7. The magnetic device of claim 1, wherein at least one permanent magnet has a bore, the flow path extending through the bore.

8. The magnetic device of claim 1, further comprising an armature dividing the at least one magnetic pretreating unit from the at least one magnetic aftertreating unit.

9. The magnetic device of claim 1, further comprising an armature dividing the at least one magnetic pretreating unit from the at least one magnetic aftertreating unit.

10. A magnetic device (1) for treating gaseous material comprising:

a housing made of magnetizable material;

permanent magnets within the housing and defining a flow path, the permanent magnets arranged at a boundary of the flow path so that the north (N) pole or the south (S) pole of said permanent magnets faces said flow path, wherein said flow path comprises:

at least one magnetic pretreating unit, said permanent magnets arranged in a plane perpendicular to the flow direction, a pair of permanent magnets having faces of opposite polarity facing one another; and at least one magnetic aftertreating unit, in which said permanent magnets are arranged with faces having the same polarity facing one another.

11. The magnetic device according to claim 10, wherein said permanent magnets are arranged on the inner wall of said housing and are embedded in synthetic resin.

12. The magnetic device according to claim 11, wherein said magnetic pretreating unit comprises;

four permanent magnets arranged in the cross-sectional plane of said flow path with faces of alternating polarity in the direction of the flow path, said permanent magnets embedded equidistantly in said synthetic resin; and a plurality of magnetic pretreating units positioned one after the other before said magnetic aftertreating unit in such a manner that with respect to their magnetic polarity the individual magnetic pretreating units relative to a preceding pretreating unit are rotated by 90° perpendicular to said flow direction.

13. The magnetic device according to claims any one of 5-7 characterized in that said gaseous material is combustible gas.

14. The magnetic device according to claim 10, wherein said housing is a body of revolution.

15. The magnetic device according to claim 10, wherein said device is arranged vertically in the path of gaseous material in such a manner that the liquid or the gaseous material is first directed through said magnetic pretreating unit, then through said magnetic aftertreating unit.

16. The magnetic device of claim 10, wherein at least one permanent magnet has a bore, the flow path extending through the bore.

* * * * *